US008387201B1

(12) United States Patent
Darby et al.

(10) Patent No.: US 8,387,201 B1
(45) Date of Patent: Mar. 5, 2013

(54) SQUEEGEE

(76) Inventors: Trond William Darby, Dexter, MI (US); Matthew Anthony Pratto, Queen Creek, AZ (US)

( * ) Notice: Subject to any disclaimer, the term of this patent is extended or adjusted under 35 U.S.C. 154(b) by 673 days.

(21) Appl. No.: 12/462,580

(22) Filed: Aug. 5, 2009

(51) Int. Cl.
*A47L 13/11* (2006.01)

(52) U.S. Cl. ..... 15/245

(58) Field of Classification Search ..... 15/117, 15/245

See application file for complete search history.

(56) References Cited

U.S. PATENT DOCUMENTS

| | | | | |
|---|---|---|---|---|
| 629,851 | A * | 8/1899 | Glen | 15/245 |
| 4,611,363 | A | 9/1986 | Samuelsson | |
| 4,727,986 | A | 3/1988 | Feldstein | |
| 5,809,608 | A * | 9/1998 | Zadro | 15/245 |
| 6,625,840 | B1 | 9/2003 | Hansen et al. | |

* cited by examiner

*Primary Examiner* — Randall Chin
(74) *Attorney, Agent, or Firm* — John G. Chupa

(57) ABSTRACT

A squeegee 10 which may operatively accommodate blades, such as blade 60, of differing lengths by the use of movable members 20, 40 which are movably coupled and which cooperatively form a blade reception slot 80 of differing and desired lengths.

1 Claim, 2 Drawing Sheets

FIG. 3
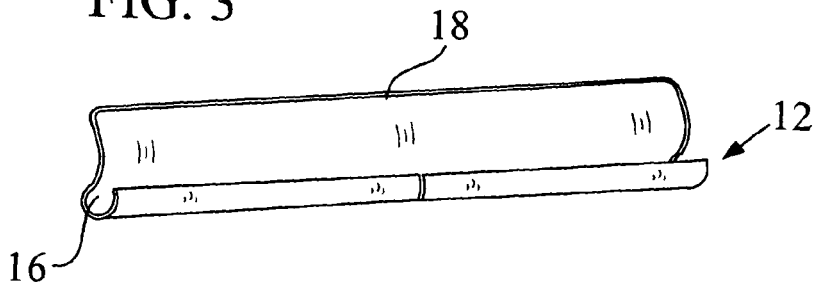
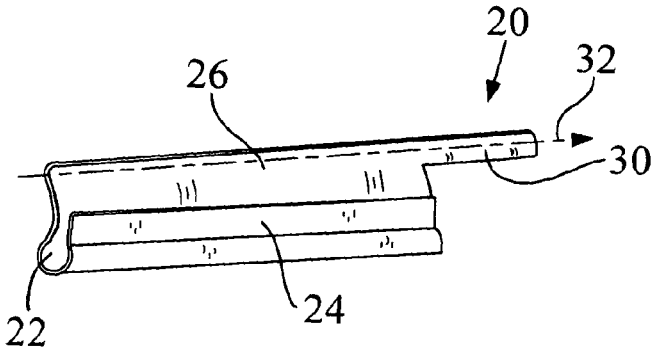
FIG. 4
FIG. 5
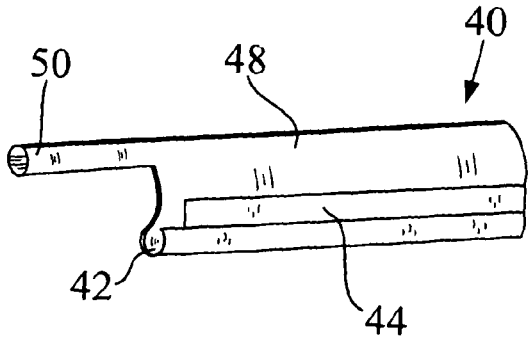

SQUEEGEE

GENERAL BACKGROUND

1. Field of the Invention

The present invention generally relates to a squeegee and more particularly to a squeegee which may selectively and operatively receive and utilize blades of different lengths.

2. Background of the Invention

A squeegee is typically used to wipe away water and/or other types of liquid material from a window or other glass objects in order to allow these objects to be cleaned. Of course, a squeegee may have a variety of other uses as well.

As is well know, the squeegee performs its function by actually being placed in contact with the object. That is, the squeegee typically includes a blade portion which is made to be in slidbale or movable contact with the object.

Objects, of course, are of various shapes and sizes and while a squeegee blade of a certain length may work well on one object (i.e. a large blade may perform very well on a large window), the same blade may be ill suited for another object (i.e., the large blade may simply be too large for placement on a small window). It is very desirable therefore to allow a squeegee to quickly and efficiently utilize a variety of blades, each having unique characteristics, such as unique lengths in order to allow the squeegee to accommodate a wide variety of objects. The present invention addresses this need in a new and novel way and obviates the need for a user to have multiple squeegees in order to accomplish a variety of tasks involving dissimilarity shaped and sized objects.

SUMMARY OF THE INVENTION

It is a first non-limiting object of the present invention to provide a squeegee which overcomes some or all of the previously delineated drawbacks of prior squeegees, such as, by way of example and without limitation, those delineated above.

It is a second non-limiting object of the present invention to provide a squeegee which may efficiently utilize a wide variety of dissimilar blades in a new and novel manner.

According to a first non-limiting aspect of the present invention, a squeegee is provided and includes a first base member; a second member which slidably resides within the first base member and which includes a hollow protruding portion; a third member which slidably resides within the first base member and which includes a protruding portion which movably resides within the hollow protruding portion; and a blade which resides within the first base member, the second member, and the third member.

According to a second non-limiting aspect of the present invention, a squeegee is provided and includes a first stationary portion having a longitudinal axis of symmetry; a second portion which is movably contained within the first stationary portion and which includes a first member having a hollow protrusion which is parallel to the longitudinal axis of symmetry and a second member having a solid protrusion which movably and selectively resides within the hollow protrusion, thereby coupling the first member to the second member and wherein the second member is selectively movable from a first retracted position in close proximity to the first member to a second extended position in a direction away from the first member; and a blade which operatively resides within the first and second member.

According to a third non-limiting aspect of the present invention, a squeegee is provided and includes a holding assembly having a base member having a U-shaped slot portion which terminates into a rear wall portion and wherein the U-shaped slot has a longitudinal axis of symmetry; a first member having a U-shaped slot portion which movably resides within the U-shaped slot portion of the base member and wherein the first member includes a front wall portion and wherein the front wall portion of the first member terminates into the U-shaped slot portion of the first member and wherein the front wall portion includes a hollow protruding portion which has a longitudinal axis of symmetry which is parallel to the longitudinal axis of symmetry of the U-shaped slot of the base member; a second member having a U-shaped slot portion which movably resides within said U-shaped slot portion of the base member and wherein the second member includes a front wall portion which terminates into the U-shaped slot portion of said second member and wherein said front wall portion of said second member includes a solid protruding portion which has a longitudinal axis of symmetry which is parallel to the longitudinal axis of symmetry of the U-shaped slot of the base member and wherein the solid protruding portion movably resides within the hollow protruding portion, thereby allowing the U-shaped slot of the first member and said U-shaped slot of the second member to cooperatively from a blade reception slot which may have a modifiable length; and a blade which is selectively and operatively disposed within the cooperatively formed blade reception slot.

These and other features, aspects, and advantages of the present inventions will become apparent from a review of the description of the preferred embodiment of the invention, including the subjoined claims, and by reference to the enclosed drawings.

BRIEF DESCRIPTION OF THE DRAWINGS

FIG. 3 is a perspective view of a first portion or member of the squeegee which is shown in FIGS. 1 and 2.

FIG. 4 is a perspective view of a second portion or member of the squeegee which is shown in FIGS. 1 and 2.

FIG. 5 is a perspective view of a third portion or member of the squeegee which is shown in FIGS. 1 and 2.

DETAILED DESCRIPTION OF THE PREFERRED EMBODIMENT OF THE INVENTION

Figure 1:
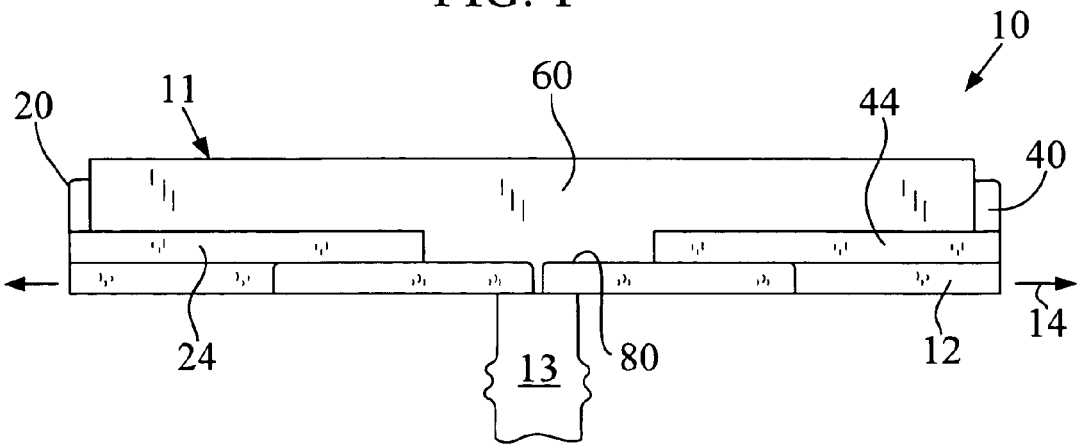
FIG. 1 is a front assembled view of a squeegee which is made in accordance with the teachings of the preferred embodiment of the invention.
Figure 2:
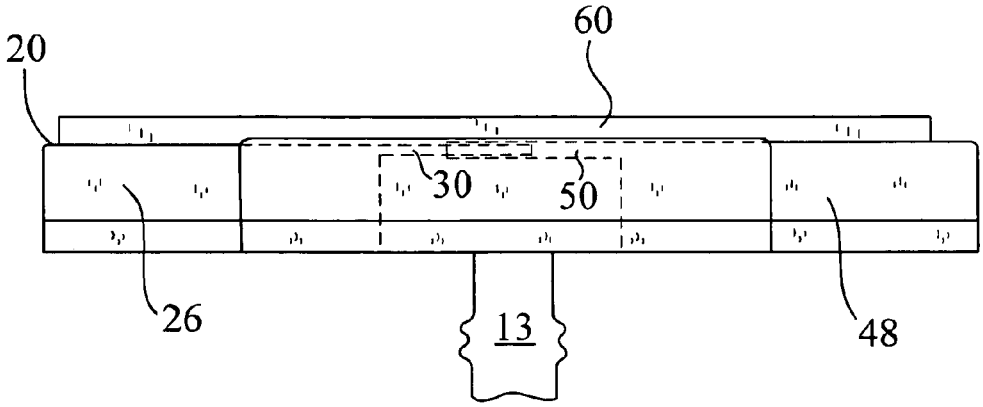
FIG. 2 is a back assembled view of the squeegee which is shown in FIG. 1 and further showing, in phantom, the selective coupling of several of the members which are deployed within the squeegee of the present invention.

Referring now to FIG. 1, there is shown a squeegee 10 which is made in accordance with the teachings of the preferred embodiment of the invention.

Particularly, squeegee 10 includes an object contacting portion 11 which is coupled to a handle 13 by a screw, bolt, or other conventional fastener. Portion 11, including a base member or portion 12 having a longitudinal axis of symmetry 14 and having a U-shaped channel or trough portion 16 which integrally terminates into a back wall portion 18. The squeegee 10 (portion 11) further includes a member or portion 20 having a U-shaped channel or trough 22 which is adapted to frictionally but movably fit within the generally u-shaped channel or trough 16. The member or portion 20 further includes a front wall portion 24 which integrally terminates into the trough or channel 22 and a back wall portion 26 which also integrally terminates into the trough or channel 22. Further, the back wall portion 26 includes a solid protrusion or "finger" 30 (which may have a tubular cross sectional area) having a longitudinal axis of symmetry 32 which is parallel to the longitudinal axis of symmetry 14.

The squeegee 10 further includes a member or portion 40 having a channel or trough portion 42 which is substantially similar to channel or trough portion 22. The member or portion 40 further includes a front wall portion 44 which is substantially similar to front wall portion 24 and a back wall portion 48. Portions 44 and 48 each respectively and integrally terminate into the channel or trough portion 42. The back wall portion 48 further includes a hollow protrusion or "finger" 50 (which may have a tubular cross sectional area), which has a longitudinal axis of symmetry which lies along the longitudinal axis of symmetry 32 and which is adapted to selectively and removably receive the protrusion 30, thereby selectively, removably and frictionally coupling the members or portions 20, 40 and aligning the channel or trough members 22 and 42 and allowing these aligned channel or trough portions 22, 42 to cooperatively form a blade reception slot 80. It should be realized that our members 20, 40 are placed within the channel 16 (within member 12), they may be selectively and frictionally moved toward and away from each other and that varying portions of protrusion 30 may lie within protrusion 50 without the connection of portion 30, to portion 50, the blade 60 as applicant has found, will undesirably flex when contact is made with an object, thereby creating streaks.

The squeegee 10 further includes a blade 60 which selectively, removably and frictionally and operatively resides within the cooperatively formed blade reception slot 80.

It should be apparent that the squeegee 10 may quickly and efficiently utilize blades of different length. That is, by moving member 20 toward and away from member 40 (i.e., by causing a larger or smaller amount of protrusion 30 to be placed within protrusion 50), the overall length of the cooperatively formed blade reception slot 80 may be easily modified, thereby accommodating blades of various lengths. Importantly, by ensuring the physical connection of back wall 26 to back wall 48 the blades (i.e., by the selective insertion of portion 30 into portion 50), the blade 60 does not leave streaks because of the firm backing and allows the entire length of the contained blade, such as blade 60, to be firmly pressed against the targeted object. In another non-limiting embodiment, a third projection, similar to projection 50, may emanate from the channel 42 and a fourth projection, such as projection 30, may emanate from channel 22. The third and fourth projections may be selectively coupled when projections 30 and 50 are coupled to provide additional stability to the coupling of portion 20 to portion 40.

It is to be understood that the present inventions are not limited to the exact construction which have been delineated above, but that various modifications may be made without departing from the spirit and the scope of the inventions as may be further delineated in the subjoined claims.

The invention claimed is:

1. A squeegee comprising a holding assembly having a base member having a U-shaped slot portion which terminates into a rear wall portion and wherein said U-shaped slot has a longitudinal axis of symmetry; a first member having a U-shaped slot portion which movably resides within said U-shaped slot portion of said base member and wherein said first member includes a front wall portion and wherein said front wall portion of said first member terminates into said U-shaped slot portion of said first member and wherein said front wall portion includes a hollow protruding portion which has a longitudinal axis of symmetry which is parallel to said longitudinal axis of symmetry of said U-shaped slot of said base member; a second member having a U-shaped slot portion which movably resides within said U-shaped slot portion of said base member and wherein said second member includes a front wall portion which terminates into said U-shaped slot portion of said second member and wherein said front wall portion of said second member includes a solid protruding portion which has a longitudinal axis of symmetry which is parallel to said longitudinal axis of symmetry of said U-shaped slot of said base member and wherein said solid protruding portion movably resides within said hollow protruding portion, thereby allowing said U-shaped slot of said first member and said U-shaped slot of said second member to cooperatively from a blade reception slot which may have a modifiable length; and a blade which is selectively and operatively disposed within said cooperatively formed blade reception slot.

* * * * *